US007004855B2

(12) United States Patent
Jordan

(10) Patent No.: US 7,004,855 B2
(45) Date of Patent: Feb. 28, 2006

(54) GOLF BALL WITH VAPOR BARRIER LAYER

(75) Inventor: Michael D. Jordan, East Greenwich, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/696,475

(22) Filed: Oct. 29, 2003

(65) Prior Publication Data

US 2004/0229716 A1 Nov. 18, 2004

Related U.S. Application Data

(60) Division of application No. 10/077,081, filed on Feb. 15, 2002, which is a continuation-in-part of application No. 09/992,448, filed on Nov. 16, 2001, now abandoned.

(51) Int. Cl.
*A63B 37/06* (2006.01)

(52) U.S. Cl. ..... 473/374

(58) Field of Classification Search ..... 473/374, 473/373, 368, 367, 376
See application file for complete search history.

(56) References Cited

U.S. PATENT DOCUMENTS

| | | | | |
|---|---|---|---|---|
| 3,241,834 | A | 3/1966 | Stingley | 273/58 |
| 3,313,545 | A | 4/1967 | Bartsch | 273/218 |
| 5,779,561 | A | 7/1998 | Sullivan et al. | 473/373 |
| 5,820,488 | A | 10/1998 | Sullivan et al. | 473/374 |
| 5,830,087 | A | 11/1998 | Sullivan et al. | 473/385 |
| 5,875,891 | A | 3/1999 | Snell | 206/315.9 |
| 5,885,172 | A | 3/1999 | Hebert et al. | 473/354 |
| 5,897,884 | A | 4/1999 | Calabria et al. | 425/116 |
| 5,919,100 | A | 7/1999 | Boehm et al. | 473/354 |
| 6,132,324 | A * | 10/2000 | Hebert et al. | 473/378 |
| 6,306,968 | B1 * | 10/2001 | Bellinger et al. | 525/179 |

FOREIGN PATENT DOCUMENTS

| | | |
|---|---|---|
| WO | WO 00/23519 | 4/2000 |
| WO | WO 01/29129 | 4/2001 |

* cited by examiner

*Primary Examiner*—Raeann Gorden

(57) ABSTRACT

A multi-layer golf ball comprising a core, a water vapor barrier layer and a cover is provided. The core may have any construction and may have multiple layers. The core may also have a solid or liquid center or wound layers, and may be constructed from a polybutadiene with mid to high Mooney viscosity. The water vapor barrier layer preferably comprises a terpolymer of ethylene, a softening acrylate class ester and methacrylic acid. th. Preferably, the water vapor barrier layer has an acid content of about 3% by weight to about 25% by weight.

9 Claims, 2 Drawing Sheets

GOLF BALL WITH VAPOR BARRIER LAYER

STATEMENT OF RELATED PATENT APPLICATION

This utility patent application is a divisional application of co-pending application Ser. No. 10/077,081, filed Feb. 15, 2002 which is a continuation-in-part of patent application entitled "Low Spin Soft Compression Performance Golf Ball" filed on Nov. 16, 2001 bearing Ser. No. 09/992,448, now abandoned. The parent applications are hereby incorporated by reference in their entirety.

FIELD OF THE INVENTION

The present invention relates to a novel structure for a golf ball, and more particularly to a golf ball with a thin moisture vapor barrier layer.

BACKGROUND OF THE INVENTION

Solid core golf balls are well known in the art. Typically, the core is made from polybutadiene rubber material, which provides the primary source of resiliency for the golf ball. U.S. Pat. Nos. 3,241,834 and 3,313,545 disclose the early work in polybutadiene chemistry. It is also known in the art that increasing the cross-link density of polybutadiene can increase the resiliency of the core. The core is typically protected by a cover from repeated impacts from golf clubs. The golf ball may comprise additional layers, which can be an outer core or an inner cover layer. One or more of these additional layers may be a wound layer of stretched elastic windings to increase the ball's resiliency.

A known drawback of polybutadiene cores cross-linked with peroxide and/or zinc diacrylate is that this material is adversely affected by moisture. Water moisture vapor reduces the resiliency of the cores and degrades its properties. A polybutadiene core will absorb water and loose its resilience. Thus, these cores must be covered quickly to maintain optimum ball properties. The cover is typically made from ionomer resins, balata, and urethane, among other materials. The ionomer covers, particularly the harder ionomers, offer some protection against the penetration of water vapor. However, it is more difficult to control or impart spin to balls with hard covers. Conventional urethane covers, on the other hand, while providing better ball control, offer less resistance to water vapor than ionomer covers.

Prolonged exposure to high humidity and elevated temperature may be sufficient to allow water vapor to invade the cores of some commercially available golf balls. For example at 110° F. and 90% humidity for a sixty day period, significant amounts of moisture enter the cores and reduce the initial velocity of the balls by 1.8 ft/s to 4.0 ft/s or greater. The change in compression may vary from 5 PGA to about 10 PGA or greater. The absorbed water vapor also reduces the coefficient of restitution (COR) of the ball.

Several prior patents have addressed the water vapor absorption problem. U.S. Pat. No. 5,820,488 discloses a golf ball with a solid inner core, an outer core and a water vapor barrier layer disposed therebetween. The water vapor barrier layer preferably has a water vapor transmission rate lower than that of the cover layer. The water vapor barrier layer can be a polyvinylidene chloride (PVDC) layer. It can also be formed by an in situ reaction between a barrier-forming material and the outer surface of the core. Alternatively, the water vapor barrier layer can be a vermiculite layer. U.S. Pat. Nos. 5,885,172 and 6,132,324 disclose, among other things, a golf ball with a polybutadiene or wound core with an ionomer resin inner cover and a relatively soft outer cover. The hard ionomer inner cover offers some resistance to water vapor penetration and the soft outer cover provides the desirable ball control. Additionally, U.S. Pat. No. 5,875,891 discloses an impermeable packaging for golf balls. The impermeable packaging acts as a moisture barrier limiting moisture absorption by golf balls during storage but not during use.

It is also desirable to minimize the thickness of the water barrier layer such that other properties of the ball are unaffected. None of these references, however, discloses an efficient way to make a thin layer of water vapor barrier layer, that otherwise would not alter the performance of the ball.

Hence, there remains a need for other golf balls with an improved water vapor barrier layer and improved methods for applying a water vapor barrier layer on to the core of the golf ball.

SUMMARY OF THE INVENTION

The present invention is directed to a golf ball comprising a core, a cover and a thin film of moisture vapor barrier with a moisture vapor transmission rate preferably lower than that of the cover to decrease the amount of moisture penetrating into the core of the golf ball. The moisture vapor barrier layer preferably comprises a non-ionomeric copolymer of ethylene and methacrylic acid. The moisture vapor barrier layer may also comprise a non-ionomeric terpolymer of ethylene, a softening acrylate class ester such as methyl acrylate, n-butyl-acrylate or iso-butyl-acrylate, and a carboxylic acid such as acrylic acid or methacrylic acid. The moisture vapor barrier layer may further comprise a non-ionomeric copolymer of ethylene and acrylic acid. Alternatively, the moisture vapor barrier layer may comprise all three materials. In accordance to another aspect of the invention, the preferred copolymer of ethylene and methacrylic acid is polyethylene methacrylic acid resin.

In accordance to another aspect of the invention, the preferred moisture vapor barrier materials have about 3% to about 25% of acid by weight, more preferably in the range of about 4% to 15%, and most preferably about 7% to about 11% of acid by weight. The preferred copolymers also have high melt flow index. High melt flow index of the preferred materials helps to reduce the thickness of the moisture vapor barrier layer. A readily apparent advantage of having a thin barrier layer is that it does not significantly alter the predetermined and desired properties of the designed golf ball. Preferably, the moisture vapor barrier has a thickness of about 0.020 inch to about 0.005 inch. Preferably, the moisture vapor barrier layer is made from two molded half shells that are compression-molded on to the core.

In accordance to another aspect of the invention, the moisture vapor barrier can be an intermediate layer, an inner cover layer, an outer core layer, a core coating or an outer cover coating. The present invention is also directed to a golf ball having a relatively large solid polybutadiene core, a thin moisture vapor barrier layer with a thermoset urethane cover. Alternatively, the water vapor barrier layer of the present invention can be used with any known core structures and covers.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE INVENTION

Figure 1:
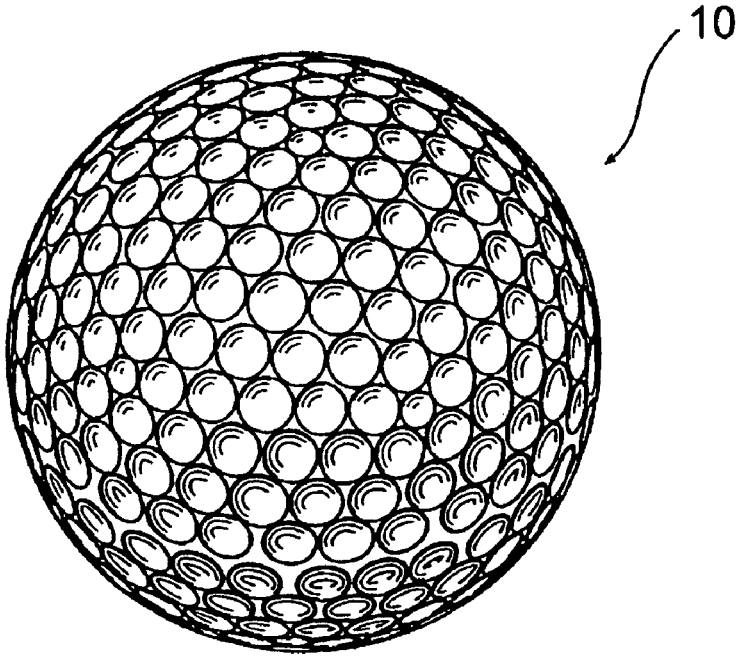
FIG. 1 is a front view of a dimpled golf ball in accordance to the present invention.
Figure 2:
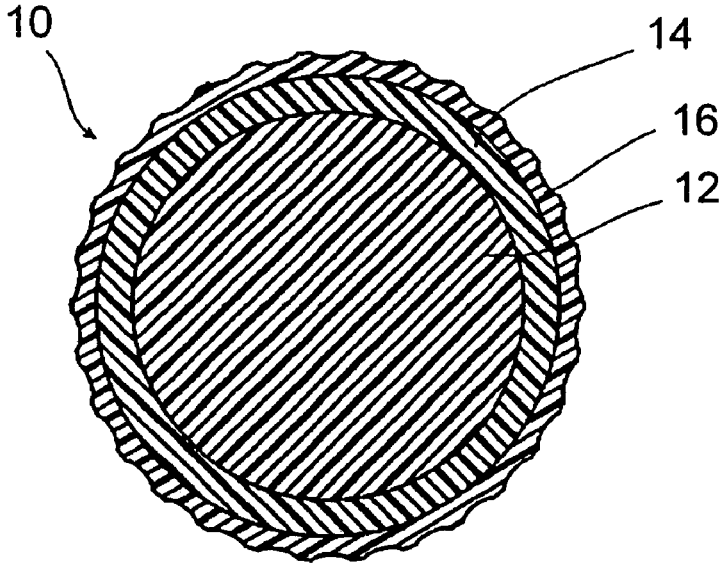
FIG. 2 is a cross-sectional view of the golf ball in FIG. 1 showing a solid core surrounded by a thin moisture vapor barrier layer and a cover.

As shown generally in FIGS. 1 and 2, where like numbers designate like parts, reference number 10 broadly designates a golf ball in accordance to the present invention. Golf ball 10 preferably has a solid core 12, an intermediate layer 14 and a cover 16.

Figure 3:
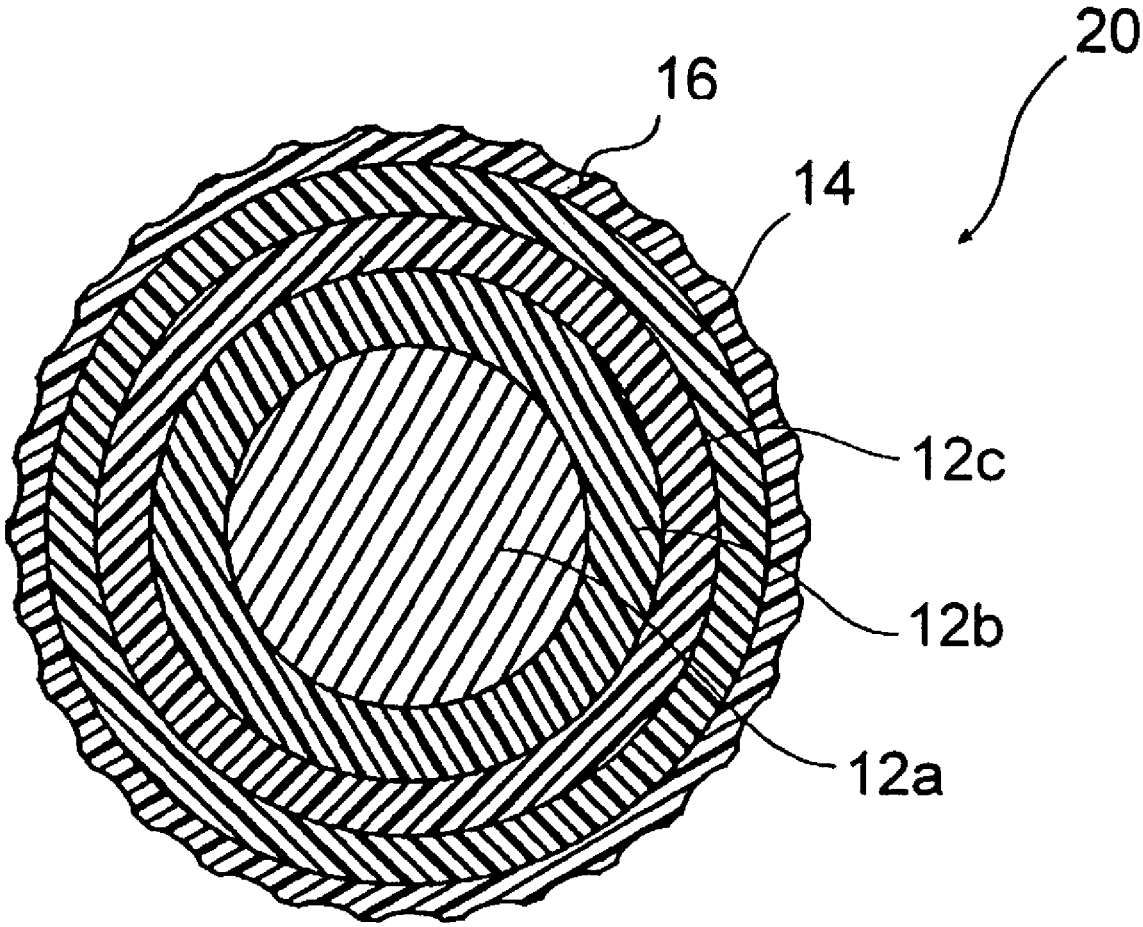
FIG. 3 is a cross-sectional view of another golf ball in accordance to the present invention showing a solid core with multiple wound layers surrounded by a thin moisture vapor barrier layer.

Solid core 12 may comprise a single spherical element, or it may comprise a core spherical element with one or more intermediate layers surrounding the spherical element as shown in FIG. 3. Solid core 12 can be made from any suitable core materials including thermoset plastics, such as natural rubber, polybutadiene (PBD), polyisoprene, styrene-butadiene or styrene-propylene-diene rubber, and thermoplastics such as ionomer resins, polyamides, polyesters, or a thermoplastic elastomer. Suitable thermoplastic elastomers include Pebax®, Hytrel®, thermoplastic urethane, and Kraton®, which are commercially available from Elf-Atochem, E. I. Du Pont de Nemours and Company, various manufacturers, and Shell Chemical Company, respectively. The core materials can also be formed from a castable material. Suitable castable materials include those comprising a urethane, polyurea, epoxy, silicone, IPN'S, etc.

Additionally, suitable core materials may also include a reaction injection molded polyurethane or polyurea, including those versions referred to as nucleated, where a gas, typically nitrogen, is essentially whipped into at least one component of the polyurethane, typically, the pre-polymer, prior to component injection into a closed mold where essentially full reaction takes place resulting in a cured polymer having reduced specific gravity. These materials are referred to as reaction injection molded (RIM) materials. Alternatively, core 12 may include a liquid center, such as center 12*a* shown in FIG. 3, and may have one or more would layers, such as intermediate layers 12*b* and 12*c*.

Preferably, core 12 is made from a polybutadiene with a mid to high range Mooney viscosity, which provides a soft but high velocity core. The core may be blended with an organic sulfur plasticizer such as pentachlorolthiophenol or a Zinc salt of pentachlorolthiophenol to further increase the softness and resiliency of the core.

The core 12 of the golf ball of the present invention preferably has a diameter in the range of about 1.53 inches to about 1.58 inches. In accordance to one aspect of the present invention, the core is made from a polybutadiene rubber that has a viscosity range from about 40 to about 60 Mooney. Polybutadiene rubber with higher Mooney viscosity may also be used, so long as the viscosity of the PBD does not reach a level where the high viscosity PBD clogs or otherwise adversely interferes with the manufacturing machinery. It is contemplated that PBD with viscosity less than 65 Mooney can be used with the present invention. A "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

Golf ball cores made with mid to high Mooney viscosity PBD material exhibit increased resiliency, hence distance, without increasing the hardness of the ball. Such cores are soft, i.e., compression of about 50–80, and when these soft cores are incorporated into golf balls such cores generate very low spin and long distance when struck by a driver. Cores with compression in the range of from about 30 to about 50 are also within the range of the present invention.

In accordance to another aspect of the invention, the addition of an organic sulfur compound to the core further increases the resiliency and the coefficient of restitution of the ball. Preferred organic sulfur compounds include, but not limited to, pentachlorothiophenol (PCTP) and a salt of PCTP. A preferred salt of PCTP is ZnPCTP. The utilization of PCTP and ZnPCTP in golf ball cores to produce soft and fast cores is disclosed in co-pending U.S. application Ser. No. 09/951,963 filed on Sep. 13, 2001, and is assigned to the same assignee as the present invention. This co-pending application is incorporated by reference herein, in its entirety. A suitable PCTP is sold by the Structol Company under the tradename A95. ZnPCTP is commercially available from eChinaChem.

Commercial sources of suitable mid to high Mooney PBD sold by Bayer AG include CB 23, which has a Mooney viscosity of about 51 and is a preferred PBD. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are based on 100 parts by weight of the total elastomer mixture.

Metal salt diacrylates, dimethacrylates, and monomethacrylates suitable for use in this invention include those where the metal is magnesium, calcium, zinc, aluminum, sodium, lithium or nickel. Zinc diacrylate (ZDA) is preferred, but the present invention is not limited thereto. ZDA provides golf balls with a high initial velocity. Free radical initiators are also used to promote cross-linking of the metal salt diacrylate, dimethacrylate, or monomethacrylate and the polybutadiene. Free radical initiators are used to promote cross-linking of the metal salt diacrylate, dimenthacrylate, or monomethacrylate and the polybutadiene rubber.

The core may also include fillers, added to the elastomeric composition to adjust the density and/or specific gravity of the core. Fillers useful in the golf ball core according to the present invention include, for example, metal (or metal alloy) powders, metal oxide, metal searates, particulate, carbonaceous materials, and the like or blends thereof.

Antioxidants may also be included in the elastomer centers produced according to the present invention. Antioxidants are compounds, which prevent the breakdown of the elastomer. Antioxidants useful in the present invention include, but are not limited to, quinoline type antioxidants, amine type antioxidants, and phenolic type antioxidants.

Other ingredients such as accelerators, processing aids, processing oils, dyes and pigments, as well as other additives well known to the skilled artisan may also be used in the present invention in amounts sufficient to achieve the purpose for which they are typically used.

The core 12 may be formed by mixing and forming the base composition using conventional techniques. Detailed disclosures concerning compositions of the core to achieve desired properties in the ball are fully disclosed in co-pending patent application Ser. No. 09/992,448. This patent application has been incorporated by reference in its entirety.

Cover 16 is preferably tough, cut-resistant, and selected from conventional materials used as golf ball covers based on the desired performance characteristics. The cover may comprise one or more layers. Suitable cover materials include ionomer resins, such as Surlyn® available from DuPont, blends of ionomer resins, thermoplastic or thermoset urethane, acrylic acid, methacrylic acid, thermoplastic rubber polymers consisting of block copolymers in which the elastomeric midblock of the molecule is an unsaturated rubber or a saturated olefin rubber, e.g., Kraton® rubbers available from Shell Chemical Co., polyethylene, and synthetic or natural vulcanized rubber such as balata. Additionally, other suitable core and cover materials are disclosed in U.S. Pat. No. 5,919,100 and international publications WO 00/23519 and WO 01/29129. These disclosures are incorporated by reference in their entirety.

Most preferably, core 12 is made from a CB-23 polybutadiene with ZnPCTP additive and tungsten filler, and cover 16 is made from a composition comprising a thermoset urethane.

To prevent or minimize the penetration of moisture, typically water vapor, into core 12 of golf ball 10, intermediate layer 14 is a moisture vapor barrier layer preferably disposed immediately around core 12. Preferably, moisture vapor barrier layer 14 has a moisture vapor transmission rate that is lower than that of the cover, and more preferably less than the moisture vapor transmission rate of an ionomer resin such as Surlyn®, which is in the range of about 0.45 to about 0.95 grams.mm/m$^2$.day. The moisture vapor transmission rate is defined as the mass of moisture vapor that diffuses into a material of a given thickness per unit area per unit time. The preferred standards of measuring the moisture vapor transmission rate include ASTM F1249-90 entitled "Standard Test Method for Water Vapor Transmission Rate Through Plastic Film and Sheeting Using a Modulated Infrared Sensor," and ASTM F372-94 entitled "Standard Test Method for Water Vapor Transmission Rate of Flexible Barrier Materials Using an Infrared Detection Technique," among others.

In accordance to one aspect of the invention, preferred materials suitable for the intermediate moisture vapor barrier layer 14 include copolymers of ethylene and methacrylic acid, having an acid level from about 3% to about 25% by weight, more preferably from about 4% to about 15%, and most preferably from about 7% to about 11%, such as polyethylene methacrylic acid resins commercially available under the tradename Nucrel® from DuPont. Copolymers of ethylene and methacrylic acid have an advantage in that these compounds typically have high melt flow index. The melt flow index, also known as the melt index, as used herein has its common and ordinary meaning, which is the amount, in grams, of a thermoplastic resin which can be forced through an extrusion rheometer orifice of 0.0825 inch diameter when subjected to a force of 2.16 kg in 10 minutes at 190° C. The melt flow index is typically measured in accordance to the ASTM D 1238 standard. The benefits of higher melt flow index include easier extrusion, higher extrusion rate, higher flow during heat sealing, and the ability to make thin films of moisture vapor barrier layer. Without limiting the present invention to any particular theory, materials with relatively high melt flow index have relatively low viscosity. Low viscosity helps the materials spread evenly and thinly to produce a thin film.

Suitable polyethylene methacrylic acid resins include, for example, Nucrel® 599 resin, which contains 10% by weight of acid and a melt flow index of 500 g/10 min, and Nucrel® 2940 which contains 19% acid by weight and a melt flow index of 395 g/10 min. These values, when compared to those of well-known ionomers such as Surlyn®, which have melt flow index typically in the range of 1 g/10 min to 14 g/10 min, show that polyethylene methacrylic acid resins have superior flow characteristic under heat. Suitable polyethylene methacrylic acid resins exhibit melt flow index in the range of about 1 g/10 min. to about 500 g/10 min., more preferably in the range of about 3 g/10 min. to about 60 g/10 min., and even more preferably less than about 35 g/10 min. or in the range of about 5 g/10 min. to about 25 g/10 min.

The inventive use of copolymers of the ethylene and methacrylic acid allows the production of very thin layers of moisture vapor barrier, which in turn allows golf ball designers to add a barrier layer to a well designed golf ball without significantly changing the designed properties of the ball. This simplifies the golf ball design process by not introducing a new factor for consideration when moisture vapor barrier capability is added to the ball.

The preferred materials, copolymers of ethylene and methacrylic acid, exhibit water vapor barrier property of about 0.01 grams.mm/m$^2$.day to 0.90 grams.mm/m$^2$.day. The thickness of intermediate layer 14 when made with the preferred materials can be as thin as less than 0.030 inch, more preferably from about 0.020 inch to about 0.005 inch. It can be readily appreciated that at this small thickness intermediate layer 14 will not significantly alter the properties of golf ball 10. More specifically, the specific gravity of copolymers of ethylene and methacrylic acid is between about 0.93 and about 0.95. With the specific gravity in this range and with the above thickness, the intermediate layer 14 would not have any significant effect on the moment of inertia of ball 10. As used herein, specific gravity is the ratio of the density of a substance to the density of water at 4° C., which is 1.0 g/cm$^3$. Furthermore, the hardness of copolymers of ethylene and methacrylic acid is available in the range of about 42 to 63 Shore D. Hence, with the hardness in this range and with the above thickness, the intermediate layer 14 would not have a significant impact on the hardness or compression of ball 10.

In accordance to another aspect of the invention, other suitable materials for the intermediate water vapor barrier layer include a blend of a copolymer of ethylene and methacrylic acid and a suitable acid terpolymer of ethylene, a softening acrylate class ester such as methyl acrylate, n-butyl-acrylate or iso-butyl-acrylate, and a carboxylic acid such as acrylic acid or methacrylic acid. Suitable examples of this acid terpolymer include terpolymers of ethylene, methyl acrylate and acrylic acid (EMAAA), commercially available under the tradename Escor® Acid Terpolymers from Exxon Mobile Chemical. Such acid terpolymers blend readily with copolymers of ethylene and methacrylic acid, and have similar physical properties. For example, these acid terpolymers have an acid content from about 6% to 6.5%, melt flow index in the range of 5–20 g/10 min, specific gravity in the range of 0.94 to 0.95 and hardness in the range of 23–41 Shore D. Hence, a thin layer of a blend comprising a copolymer of ethylene and methacrylic acid and a terpolymer of ethylene, methyl acrylate and acrylic acid would protect the golf ball core from water vapor invasion while not significantly alter the other properties of the ball. Preferably, this blend comprises 75% of a copolymer of ethylene and methacrylic acid and 25% of a suitable acid terpolymer, e.g., EMAAA terpolymer, or 25% of a copolymer of ethylene and methacrylic acid and 75% of acid terpolymer, or 50% of each component. Alternatively, the water vapor barrier layer may comprise the acid terpolymer without a copolymer of ethylene methacrylic acid.

In accordance to another aspect of the invention, another suitable material for the intermediate water vapor barrier layer is a blend of a copolymer of ethylene and methacrylic acid and a copolymer of ethylene and acrylic acid. Such copolymers of ethylene and acrylic acid are commercially available as Primacor® copolymers from Dow Plastics, and also have high acid content and high melt flow index. Typical acrylic acid levels in commercial copolymers of ethylene and acrylic acid range from about 3% and about 20.5% and the melt flow index can be in the range of 300 g/10 min or higher. Similarly, the hardness level of this materials is available in the range of 50 on the Shore D scale, and the specific gravity is available in the range of 0.96. Hence, a thin layer of a blend comprising a copolymer of ethylene and methacrylic acid and a copolymer of ethylene and acrylic acid would protect the golf ball core from water vapor invasion while not significantly alter the other properties of the ball. Preferably, this blend comprises 25% of a copolymer of ethylene and methacrylic acid and 75% of a copolymer of ethylene and acrylic acid, or 75% of copolymer of ethylene and methacrylic acid and 25% of copolymer of ethylene and acrylic acid, or 50% of each copolymer. Alternatively, the water vapor barrier may comprise a copolymer of ethylene and acrylic acid, but not a copolymer of ethylene and methacrylic acid.

In accordance to another aspect of the invention, the intermediate water vapor barrier layer 14 can be made from a blend of (i) a copolymer of ethylene and methacrylic acid, (ii) a terpolymer of ethylene, methyl acrylate and acrylic acid and (iii) a copolymer of ethylene and acrylic acid. In accordance to another aspect of the invention, the intermediate water vapor barrier may also include one or more of the water vapor barrier materials disclosed in co-pending patent application Ser. No. 09/973,342, which is assigned to the same assignee as the present invention and which is incorporated herein by reference. The suitable materials discussed above are all non-ionomeric compounds, which are compounds that are free of ions. Other non-ionomeric compounds may also be suitable as a moisture vapor barrier layer.

Using CB-23 polybutadiene discussed above with the organic sulfur compound ZnPCTP and tungsten fillers among other additives, prototype cores 12 having 1.58 inch diameter with core compression of 60, 65 and 75, respectively, were made. Each core then has a thin layer of 0.020 inch of polyethylene methacrylic acid resin (10.5% acid by weight) cased thereon. The subassembly then is covered by a thermoset urethane cover. It has also been observed that resins having lower levels of acid by weight generally achieve more desirable water vapor barrier property.

The physical properties of the three prototypes are compared to those of two known commercial balls, Pinnacle Gold LS and Titleist Pro-V1, as shown below:

| Ball Type | Initial Velocity (ft/s) | Ball Compression | Weight (oz.) | Hardness on Cover (Shore D) | CoR |
|---|---|---|---|---|---|
| Pinnacle Gold LS | 252.4 | 86 | 1.612 | 67 | — |
| Titleist Pro-V1 | 253.6 | 90 | 1.611 | 58 | — |
| Prototype A- (60 core compression) | 252.9 | 63 | 1.602 | 49 | 0.803 |
| Prototype B- (65 core compression) | 253.4 | 71 | 1.606 | 51 | 0.809 |
| Prototype C- (75 core compression) | 254.1 | 80 | 1.610 | 52 | 0.814 |

The flight characteristics of the prototypes when struck by various mechanical clubs are shown below:

| | Pro 175 (175 ft/s) | | Standard Driver (160 ft/s) | | Average Driver (140 ft/s) | | 8 Iron | | Half Wedge | |
|---|---|---|---|---|---|---|---|---|---|---|
| Ball Type | Spin (rev/min) | Speed (ft/s) | Spin (rev/min) | Speed (ft/s) | Spin (rev/min) | Speed (ft/s) | Spin (rev/min) | Speed (ft/s) | Spin (rev/min) | Speed (ft/s) |
| Pinnacle Gold LS | 2790 | 174.3 | 2962 | 159.4 | 3538 | 139.8 | 7641 | 114.9 | 4564 | 51.7 |
| Titleist Pro-V1 | 3137 | 175.0 | 3356 | 160.6 | 3960 | 140.1 | 7935 | 115.1 | 7020 | 52.9 |
| Prototype A- (60 core compression) | 2983 | 173.4 | 3076 | 159.5 | 3685 | 140.3 | 7245 | 115.0 | 6814 | 53.5 |
| Prototype B- (65 core compression) | 3100 | 174.1 | 3118 | 159.8 | 3787 | 140.9 | 7458 | 114.8 | 6866 | 53.4 |
| Prototype C- (75 core compression) | 3208 | 174.7 | 3340 | 160.2 | 4404 | 141.7 | 7845 | 115.3 | 7093 | 53.2 |

Hence, the physical properties and flight characteristics of balls made in accordance to the present invention are similar to and in some cases exceed those of commercially successful balls.

In accordance to another aspect of the invention, the moisture vapor barrier layer 14 may be made by a number of methods. A preferred method is the pre-formed semi-cured shells method, where a quantity of mixed stock of the preferred moisture vapor barrier material is placed into a compression mold and molded under sufficient pressure, temperature and time to produce semi-cured, semi-rigid half-shells. The half-shells are then place around a core (solid or wound) and the sub-assembly is cured in another compression molding machine to complete the curing process and to reach the desirable size. A cover is then formed on the core sub-assembly by any known method to complete the fabrication of the ball.

As discussed above, the high melt flow index of the preferred materials allows the construction of desirable thin half-shells of water vapor barrier material, such that this layer do not significantly alter the properties of the ball.

Other suitable manufacturing techniques include sheet stock and vacuum, rubber injection molding, spraying, dipping, casting, vacuum deposition, reaction injection molding, among others. A two-pack casting method, such as the one disclosed in U.S. Pat. No. 5,897,884, may also be used. A simplified casting method using a single blocked material to produce the moisture vapor barrier layer 14 can also be used. More particularly, this simplified method is usable to make any castable components of the golf ball, including the moisture vapor barrier layer, any intermediate layer, the innermost core or any portion of the cover. The suitable manufacturing methods discussed herein are discussed in more details in co-pending patent application Ser. No. 09/973,342, which has been incorporated by reference in its entirety.

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising a core, a water vapor barrier layer and a cover, wherein the water vapor barrier layer has a moisture vapor transmission rate that is lower than that of the cover and the water vapor barrier layer comprises a non-ionomeric terpolymer of ethylene, a softening acrylate class ester such as methyl acrylate, n-butyl-acrylate or iso-butyl-acrylate, and a carboxylic acid such as acrylic acid or methacrylic acid.

2. The golf ball set forth in claim 1, wherein the terpolymer is a terpolymer of ethylene, methyl acrylate and acrylic acid.

3. The golf ball as set forth in claim 1, wherein the acid level by weight in the terpolymer is in the range of about 3% to about 25%.

4. The golf ball as set forth in claim 3, wherein the acid level by weight in the terpolymer is in the range of about 4% to about 15%.

5. The golf ball as set forth in claim 4, wherein the acid level by weight in the terpolymer is in the range of about 7% to about 11%.

6. The golf ball set forth in claim 1, wherein the terpolymer has a melt flow index in the range between about 1 gram/10 minutes to about 500 grams/10 minutes.

7. The golf ball set forth in claim 6, wherein the melt flow index of the terpolymer is in the range of about 5 grams/10 minutes to about 20 grams/10 minutes.

8. A golf ball comprising a core, a water vapor barrier layer and a cover, wherein the water vapor barrier layer has a moisture vapor transmission rate that is lower than that of the cover and the water vapor barrier layer comprises a blend of a terpolymer of ethylene, a softening acrylate class ester, and a carboxylic acid having a melt flow index in the range of about 5–20 g/10 mm and a non-ionomeric copolymer of ethylene and methacrylic acid.

9. The golf ball as set forth in claim 8, wherein the terpolymer is present in an amount of about 25%, 50% or 75% and the non-ionomeric copolymer is present in an amount of about 75%, 50% or 25%.

* * * * *